US007583164B2

(12) United States Patent
Pance et al.

(10) Patent No.: US 7,583,164 B2
(45) Date of Patent: Sep. 1, 2009

(54) DIELECTRIC RESONATORS WITH AXIAL GAPS AND CIRCUITS WITH SUCH DIELECTRIC RESONATORS

(76) Inventors: Kristi Dhimiter Pance, 9 Tudor Ter., Auburndale, MA (US) 02466; Ronald Francis Hebert, 40 Roper La., Tewksbury, MA (US) 01876; Paul John Schwab, 5 Delta Dr., Nashua, NH (US) 03060

( * ) Notice: Subject to any disclaimer, the term of this patent is extended or adjusted under 35 U.S.C. 154(b) by 0 days.

(21) Appl. No.: 11/236,079

(22) Filed: Sep. 27, 2005

(65) Prior Publication Data

US 2007/0115080 A1 May 24, 2007

(51) Int. Cl.
*H01P 1/20* (2006.01)
*H01P 7/10* (2006.01)

(52) U.S. Cl. ..... 333/202; 333/219.1

(58) Field of Classification Search ..... 333/202, 333/219.1

See application file for complete search history.

(56) References Cited

U.S. PATENT DOCUMENTS

| | | | | |
|---|---|---|---|---|
| 3,475,642 | A | 10/1969 | Karp et al. | 315/3.5 |
| 4,028,652 | A | 6/1977 | Wakino et al. | 333/73 W |
| 4,138,652 | A | 2/1979 | Nishikawa et al. | 333/82 R |
| 4,267,537 | A | 5/1981 | Karmel | 333/231 |
| 4,283,649 | A | 8/1981 | Heinouchi | 310/324 |
| 4,423,397 | A | 12/1983 | Nishikawa et al. | 333/202 |
| 4,459,570 | A | 7/1984 | Delaballe et al. | 333/202 |
| 4,477,785 | A | 10/1984 | Atia | 333/202 |
| 4,578,655 | A | 3/1986 | Etienne et al. | 333/202 |
| 4,620,168 | A | 10/1986 | Delestre et al. | 333/202 |
| 4,661,790 | A | 4/1987 | Gannon et al. | 333/234 |
| 4,757,289 | A | 7/1988 | Kosugi et al. | 333/209 |
| 4,810,984 | A | 3/1989 | Arnold et al. | 333/202 |
| 4,821,006 | A | 4/1989 | Ishikawa et al. | 333/202 |
| 4,835,498 | A | 5/1989 | Rouger et al. | 333/205 |
| 4,881,051 | A | 11/1989 | Tang et al. | 333/208 |
| 5,059,929 | A | 10/1991 | Tanaka | 333/219.1 |
| 5,109,207 | A | 4/1992 | Aizawa et al. | 333/222 |
| 5,140,285 | A | 8/1992 | Cohen | 331/96 |
| 5,218,330 | A | 6/1993 | Omiya et al. | 333/223 |
| 5,347,246 | A | 9/1994 | Remillard et al. | 333/219 |
| 5,525,945 | A | 6/1996 | Chiappetta et al. | 333/202 |
| 5,614,875 | A | 3/1997 | Jang et al. | 333/202 |

(Continued)

FOREIGN PATENT DOCUMENTS

DE 39 28 015 3/1990

(Continued)

OTHER PUBLICATIONS

Hui et al. "Dielectric Ring-Gap Resonator for Application in MMIC's" IEEE Transactions on Microwave Theory and Techniques vol. 39, No. 12, Nov. 1991.

(Continued)

*Primary Examiner*—Benny Lee
(74) *Attorney, Agent, or Firm*—Jaeckle Fleischmann & Mugel, LLP

(57) ABSTRACT

A dielectric resonator with an air (or other dielectric) gap axially interrupting the body of the resonator and circuits employing such resonators. Preferably, the resonator body is conical or a stepped cylinder. However, the invention also is workable with a straight-sided cylindrical resonator body.

22 Claims, 6 Drawing Sheets

U.S. PATENT DOCUMENTS

| | | | | |
|---|---|---|---|---|
| 5,691,677 | A | 11/1997 | De Maron et al. | 333/219.1 |
| 5,748,058 | A | 5/1998 | Scott | 333/202 |
| 5,777,534 | A | 7/1998 | Harrison | 333/202 |
| 5,841,330 | A | 11/1998 | Wenzel et al. | 333/202 |
| 5,859,574 | A | 1/1999 | Schmitt | 333/202 |
| 5,949,309 | A | 9/1999 | Correa | 333/202 |
| 5,990,767 | A | 11/1999 | Ivanov et al. | 333/219.1 |
| 6,087,910 | A | 7/2000 | Matsumoto et al. | 333/202 |
| 6,100,703 | A | 8/2000 | Davidov et al. | 324/631 |
| 6,111,339 | A | 8/2000 | Ohya et al. | 310/358 |
| 6,208,227 | B1 | 3/2001 | Remillard et al. | 333/219 |
| 6,254,708 | B1 | 7/2001 | Cappabianca | 156/89.12 |
| 6,262,639 | B1 | 7/2001 | Shu et al. | 333/202 |
| 6,337,664 | B1 | 1/2002 | Mayes et al. | 343/749 |
| 6,402,981 | B1 | 6/2002 | Sasaki | 252/62.9 PZ |
| 6,707,353 | B1 | 3/2004 | Yamakawa et al. | 333/202 |
| 6,717,490 | B1 | 4/2004 | Mayer | 333/202 |
| 6,784,768 | B1 | 8/2004 | Pance et al. | 333/219 |
| 2004/0051602 | A1 | 3/2004 | Pance et al. | 333/202 |
| 2004/0051603 | A1 | 3/2004 | Pance et al. | 333/202 |
| 2006/0197631 | A1* | 9/2006 | Pance et al. | 333/202 |
| 2006/0238276 | A1* | 10/2006 | Pance et al. | 333/219.1 |

FOREIGN PATENT DOCUMENTS

| | | | |
|---|---|---|---|
| EP | 0 492 304 | A1 | 7/1992 |
| EP | 0 601 370 | A1 | 6/1994 |
| EP | 1 162 684 | A3 | 12/2001 |
| EP | 1 181 740 | B1 | 3/2003 |
| EP | 1 575 118 | | 9/2005 |
| GB | 1 376 938 | | 11/1974 |
| GB | 1 520 473 | | 9/1978 |
| JP | 57-014202 | A | 1/1982 |
| JP | 59-202701 | | 11/1984 |
| JP | 363280503 | A | 11/1988 |
| JP | 01-144701 | | 6/1989 |
| JP | 02-042898 | A | 2/1990 |
| JP | 02-137502 | | 5/1990 |
| JP | 02-168702 | | 6/1990 |
| JP | 05-102714 | | 4/1993 |
| JP | 05-267940 | | 10/1993 |
| JP | 06-061714 | | 3/1994 |
| JP | 07-154114 | A | 6/1995 |
| JP | 07-154116 | | 6/1995 |
| JP | 03-249803 | | 9/2003 |
| WO | WO 00/70706 | | 11/2000 |
| WO | WO 01/43221 | | 6/2001 |
| WO | WO 2004/027917 | | 4/2004 |

OTHER PUBLICATIONS

D. Kajfez and P. Guillon "Dielectric Resonators", ISBN 0-89006-201-3, Publisher Artech House, Dedham, MA 1986, pp. 298-317.

E. J. Heller, "Quantum Proximity Resonances", Physical Review Letters, vol. 77, No. 20, Nov. 11, 1966 The American Physical Society, pp. 4122-4125.

K. Pance et al., "Tunneling Proximity Resonances: Interplay Between Symmetry and Dissipation", Physics Department, Northwestern University Aug. 2, 1999, T-143, pp. 16-18, F426.

Kishk et al., "Conical Dielectric Resonator Antennas for Wide-Band Applications," IEEE Transactions on Antennas and Propogation 50(4); 469-474 (2002).

M. A. Gerdine, "A Frequency-Stabilized Microwave Band-Rejection Filter Using High Dielectric Constant Resonantors", IEEE Transactions on Microwave Theory and Techniques, vol. MTT-17, No. 7, Jul. 1969, pp. 354-359.

S. Verdeyme & P. Guillon, "New Direct Coupling Configuration Between $TE_{01\delta}$ Dielectric Resonator Modes" Electronics Letters, $25^{th}$ May 1989, vol. 25, No. 11, pp. 693-694.

T. Nishikawa et al., "Dielectric High-Power Bandpass Filter Using Quarter-Cut $TE_{01\delta}$ Image Resonator for Cellular Base Stations", IEEE Transactions on Microwave Theory and Techniques, vol. MTT-35, No. 12, Dec. 1987, pp. 1150-1155.

* cited by examiner

DIELECTRIC RESONATORS WITH AXIAL GAPS AND CIRCUITS WITH SUCH DIELECTRIC RESONATORS

FIELD OF THE INVENTION

The invention pertains to dielectric resonators, such as those used in microwave circuits for concentrating electric fields, and to the circuits made from them, such as microwave filters.

BACKGROUND OF THE INVENTION

Dielectric resonators are used in many circuits, particularly microwave circuits, for concentrating electric fields. They can be used to form filters, oscillators, triplexers, and other circuits. The higher the dielectric constant of the dielectric material from which the resonator is formed, the smaller the space within which the electric fields are concentrated. Suitable dielectric materials for fabricating dielectric resonators are available today with dielectric constants ranging from approximately 10 to approximately 150 (relative to air). These dielectric materials generally have a mu (magnetic constant, often represented as $\mu$) of 1, i.e., they are transparent to magnetic fields.

However, it is essentially impossible to build an effective dielectric resonator circuit with dielectric resonators having a dielectric constant greater than about 45. Specifically, as the dielectric constant increases above about 45, it becomes extremely difficult to tune such filters and other circuits because of the strong field concentrations in and around the dielectric resonators (mostly inside the dielectric resonators, but with some field outside). Spurious response, in particular, becomes a huge problem in connection with low frequency circuits, e.g., 800 MHz and lower). Poor spurious response is particularly a problem with respect to lower frequency applications because the dielectric resonators at lower frequencies must be physically larger.

FIG. 1 is a perspective view of a typical cylindrical or doughnut-type dielectric resonator of the prior art that can be used to build dielectric resonator circuits, such as filters. As can be seen, the resonator 10 is formed as a cylinder 12 of dielectric material with a circular, longitudinal through hole 14. While dielectric resonators have many uses, their primary use is in connection with microwave circuits and particularly, in microwave communication systems and networks.

As is well known in the art, dielectric resonators and resonator filters have multiple modes of electrical fields and magnetic fields concentrated at different frequencies. A mode is a field configuration corresponding to a resonant frequency of the system as determined by Maxwell's equations. In a typical dielectric resonator circuit, the fundamental resonant mode, i.e., the field having the lowest frequency, is the transverse electric field mode, $TE_{01}$ (or TE, hereafter). The electric field of the TE mode is circular and is oriented transverse of the cylindrical puck 12. It is concentrated around the circumference of the resonator 10, with some of the field inside the resonator and some of the field outside the resonator. A portion of the field should be outside the resonator for purposes of coupling between the resonator and other microwave devices (e.g., other resonators or input/output couplers) in a dielectric resonator circuit.

It is possible to arrange circuit components so that a mode other than the TE mode is the fundamental mode of the circuit and, in fact, this is done sometimes in dielectric resonator circuits. Also, while typical, there is no requirement that the fundamental mode be used as the operational mode of a circuit, e.g., the mode within which the information in a communications circuit is contained.

The second mode (i.e., the mode having the second lowest frequency) normally is the hybrid mode, $H_{11\delta}$ (or $H_{11}$ mode hereafter). The next lowest-frequency mode that interferes with the fundamental mode usually is the transverse magnetic or $TM_{01\delta}$ mode (hereinafter the TM mode). There are additional higher order modes. Typically, all of the modes other than the fundamental mode, e.g., the TE mode, are undesired and constitute interference. The $H_{11}$ mode, however, typically is the only interference mode of significant concern. However, the TM mode sometimes also can interfere with the TE mode, particularly during tuning of dielectric resonator circuits. The H11 and TM modes are orthogonal to the TE mode and are axial modes, that is, their field lines run in the direction of the axis of the DR.

The remaining modes usually have substantial frequency separation from the TE mode and thus do not cause significant interference or spurious response with respect to the operation of the system. The $H_{11}$ mode and the TM mode, however, can be rather close in frequency to the TE mode and thus can be difficult to separate from the TE mode in operation. In addition, as the bandwidth (which is largely dictated by the coupling between electrically adjacent dielectric resonators) and center frequency of the TE mode are tuned, the center frequency of the TE mode and the $H_{11}$ mode move in opposite directions toward each other. Thus, as the TE mode is tuned to increase its center frequency, the center frequency of the $H_{11}$ mode inherently moves downward and, thus, closer to the TE mode center frequency. The TM mode typically is widely spaced in frequency from the fundamental TE mode when the resonator is in open space. However, when metal is close to the resonator, such as would be the case in many dielectric resonator filters and other circuits which use tuning plates near the resonator in order to tune the center of frequency of the resonator, the TM mode drops in frequency. As the tuning plate or other metal is brought closer to the resonator, the TM mode drops extremely rapidly in frequency and can come very close to the frequency of the fundamental TE mode.

FIG. 2 is a perspective view of a microwave dielectric resonator filter 20 of the prior art employing a plurality of dielectric resonators 10*a*, 10*b*, 10*c*, 10*d*. The resonators 10*a*, 10*b*, 10*c*, 10*d*are arranged in the cavity 22 of an enclosure 24. Microwave energy is introduced into the cavity via a coupler 28 coupled to a cable, such as a coaxial cable. Conductive separating walls 32*a*, 32*b*, 32*c*, 32*d*separate the resonators from each other and block (partially or wholly) coupling between physically adjacent resonators 10*a*, 10*b*, 10*c*. Particularly, irises 30*a*, 30*b*, 30*c* in walls 32*b*, 32*c*, 32*d*, respectively, control the coupling between adjacent resonators 10*a*, 10*b*, 10*c*, 10*d*. Walls without irises generally prevent any coupling between adjacent resonators. Walls with irises allow some coupling between adjacent resonators. By way of example, the field of resonator 10*a* couples to the field of resonator 10*b* through iris 30*a*, the field of resonator 10*b* further couples to the field of resonator 10*c* through iris 30*b*, and the field of resonator 10*c* further couples to the field of resonator 10*d* through iris 30*c*. Wall 32*a*, which does not have an iris, prevents the field of resonator 10*a* from coupling with physically adjacent resonator 10*d* on the other side of the wall 32*a*. Conductive adjusting screws may be placed in the irises to further affect the coupling between the fields of the resonators and provide adjustability of the coupling between the resonators, but are not shown in the example of FIG. 2.

One or more metal plates 42 may be attached by screws 43 to the top wall (not shown for purposes of clarity) of the enclosure to affect the field of the resonator and help set the center frequency of the filter. Particularly, screws 43 may be rotated to vary the spacing between the plate 42 and the resonator 10*a*, 10*b*, 10*c*, or 10*d*to adjust the center frequency of the resonator. An output coupler 40 is positioned adjacent the last resonator 10*d* to couple the microwave energy out of the filter 20 and into a coaxial connector (not shown). Signals also may be coupled into and out of a dielectric resonator circuit by other methods, such as microstrips positioned on the bottom surface 44 of the enclosure 24 adjacent the resonators. The sizes of the resonator pucks 10, their relative spacing, the number of pucks, the size of the cavity 22, and the size of the irises 30*a*, 30*b*, 30*c* all need to be precisely controlled to set the desired center frequency of the filter and the bandwidth of the filter. More specifically, the bandwidth of the filter is controlled primarily by the amount of coupling of the electric and magnetic fields between the electrically adjacent resonators. Generally, the closer the resonators are to each other, the more coupling between them and the wider the bandwidth of the filter. On the other hand, the center frequency of the filter is controlled largely by the sizes of the resonators themselves and the sizes of the conductive plates 42 as well as the distance of the plates 42 from their corresponding resonators 10. Generally, as the resonator gets larger, its center frequency gets lower.

The volume and configuration of the conductive enclosure 24 substantially affects the operation of the system. The enclosure minimizes radiative loss. However, it also has a substantial effect on the center frequency of the TE mode. Accordingly, not only must the enclosure usually be constructed of a conductive material, but also it must be very precisely machined to achieve the desired center frequency performance, thus adding complexity and expense to the fabrication of the system.

SUMMARY OF THE INVENTION

Accordingly, it is an object of the present invention to provide improved dielectric resonators.

It is another object of the present invention to provide improved dielectric resonator circuits.

It is a further object of the present invention to provide dielectric resonator circuits with improved mode separation and spurious response.

It is one more object of the present invention to provide dielectric resonator circuits that are easy to tune.

In accordance with principles of the present invention, a dielectric resonator is provided with an air (or other dielectric) gap axially interrupting the body of the resonator. Preferably, the resonator body is conical or a stepped cylinder. However, the invention is equally workable with a straight-sided cylindrical resonator body. Filters and other dielectric resonator circuits can be built using such resonators that will have improved spurious response and be more easily tunable.

DETAILED DESCRIPTION OF THE INVENTION

U.S. Patent Publication No. 2004/0051602, which is fully incorporated herein by reference, discloses new dielectric resonators as well as circuits using such resonators. One of the primary advantages of the new resonators disclosed in the aforementioned patent application is that the field strength of the TE mode field outside of and adjacent the resonator varies along the longitudinal dimension of the resonator. A key feature of these new resonators that helps achieve this goal is that the cross-sectional area of the resonator measured parallel to the field lines of the TE mode varies along the axial direction of the resonator, i.e., perpendicularly to the TE mode field lines. In one embodiment, the cross-section varies monotonically as a function of the longitudinal dimension of the resonator, i.e., the cross-section of the resonator changes in only one direction (or remains the same) as a function of height. In one preferred embodiment, the resonator is conical, as discussed in more detail below. Preferably, the cone is a truncated cone.

Figure 1:
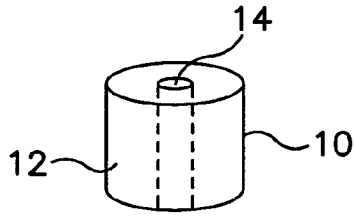
FIG. 1 PRIOR ART
FIG. 1 is a perspective view of an exemplary conventional cylindrical dielectric resonator.
Figure 2:
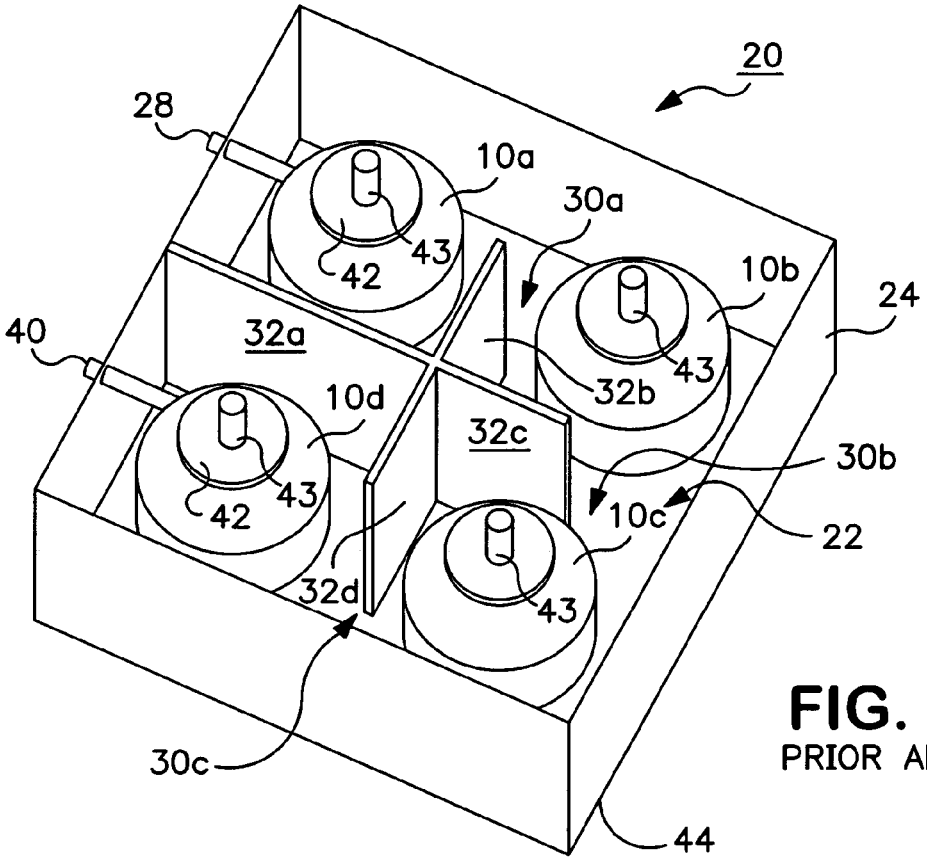
FIG. 2 PRIOR ART
FIG. 2 is a perspective view of an exemplary conventional microwave dielectric resonator filter circuit.
Figure 3:
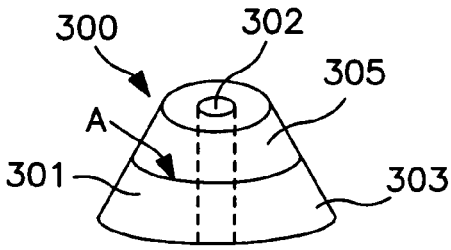
FIG. 3 is a perspective view of a truncated conical resonator in which the principles of the present invention can be used to particular advantage.

FIG. 3 is a perspective view of an exemplary embodiment of a dielectric resonator disclosed in the aforementioned patent application. As shown, the resonator 300 is formed in the shape of a truncated cone 301 with a central, longitudinal through hole 302. This design has many advantages over conventional, cylindrical dielectric resonators, including physical separation of the $H_{11}$ mode from the TE mode and/or almost complete elimination of the $H_{11}$ mode. Specifically, the TE mode electric field tends to concentrate in the base 303 of the resonator while the $H_{11}$ mode electric field tends to concentrate at the top 305 (narrow portion) of the resonator. The longitudinal displacement of these two modes improves performance of the resonator (or circuit employing such a resonator) because the conical dielectric resonators can be positioned adjacent other microwave devices (such as other resonators, microstrips, tuning plates, and input/output coupling loops) so that their respective TE mode electric fields are close to each other and therefore strongly couple, whereas their respective $H_{11}$ mode electric fields remain further apart from each other and, therefore, do not couple to each other nearly as strongly, if at all. Accordingly, the $H_{11}$ mode would not couple to the adjacent microwave device nearly as much as in the prior art, where the TE mode and the $H_{11}$ mode are physically located much closer to each other.

In addition, the mode separation (i.e., frequency spacing between the modes) is increased in a conical resonator. Even further, the top of the resonator may be truncated to eliminate much of the portion of the resonator in which the $H_{11}$ mode field would be concentrated, thereby substantially attenuating the strength of the H11 mode.

Figure 4:
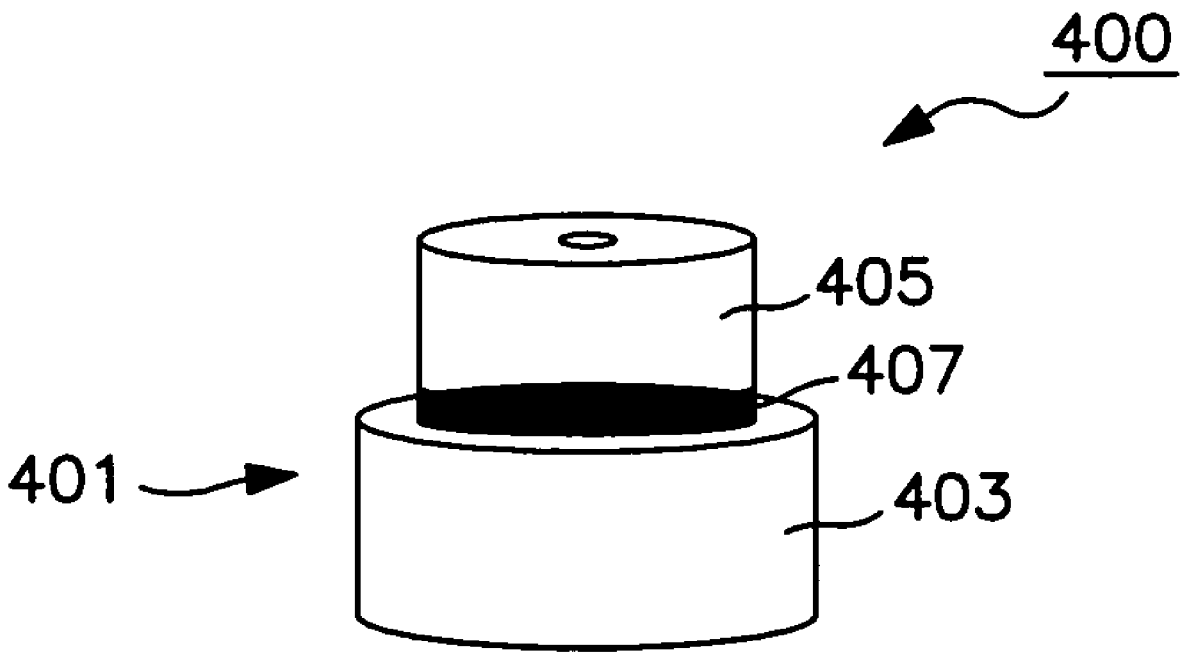
FIG. 4 is a side view of a dielectric resonator in accordance with a first embodiment of the invention.

FIG. 4 is a side view of a dielectric resonator 400 in accordance with the first embodiment of the present invention. The resonator body 401 essentially comprises a first cylinder portion 403, a second cylinder portion 405 having a smaller diameter and a dielectric gap 407 between the two portions. The two-step cylindrical body design is merely exemplary. The key concept is that there is a dielectric gap through which axial field lines generated in the resonator body must pass. The gap interrupts the continuity of the dielectric material in the axial dimension. The Maxwell equations show that gaps as small as 100-1000 atoms (in which the resonators virtually touch each other) are sufficient to significantly affect the fields of the axial modes. In a preferred embodiment, the gap 407 spans the entire distance between the dielectric resonator portions 403, 405 so that the continuity through that material is completely interrupted for all field lines.

The gap may be an air gap. Alternately, a plastic disc can be placed between the two body portions 403, 405. The material filling the gap should be a material with a dielectric constant lower than that of the dielectric resonator material out of which portions 403 and 405 are constructed, preferably much lower and, most preferably, close to or equal to 1. The latter design is desirable because it is simpler to manufacture in the sense that the three pieces, i.e., the first cylinder, the second cylinder of smaller diameter and the plastic shim can be glued together to form the resonator body. An air gap would require some mechanism for maintaining the two dielectric portions 403, 405 adjacent each other, but not in contact.

The two-step cylindrical resonator body embodiment illustrated in FIG. 4 has the advantages of a monotonically varying cross-section that provides the primary benefits of a conical-type resonator in accordance with aforementioned U.S. Patent Pulbiation No. 204/0051602, yet is much less expensive to produce. Specifically, conical resonators are expensive to machine, whereas a two-step cylindrical resonator in accordance with the present invention can be inexpensively created from two conventional cylindrical resonators stacked upon each other with a gap therebetween.

The gap 407 improves spurious response by providing greater frequency separation between the fundamental TE mode and the spurious modes, most notably, the $H_{11}$ mode and the TM mode. Particularly, it pushes the H11 and TM modes upward in frequency.

The axial gap interrupts the field lines of the axial modes, e.g., the TM and H11 modes, but essentially does not affect the field lines of the transverse TE mode. Accordingly, it has no effect on either the Q or the frequency of the TE mode.

Figure 5:
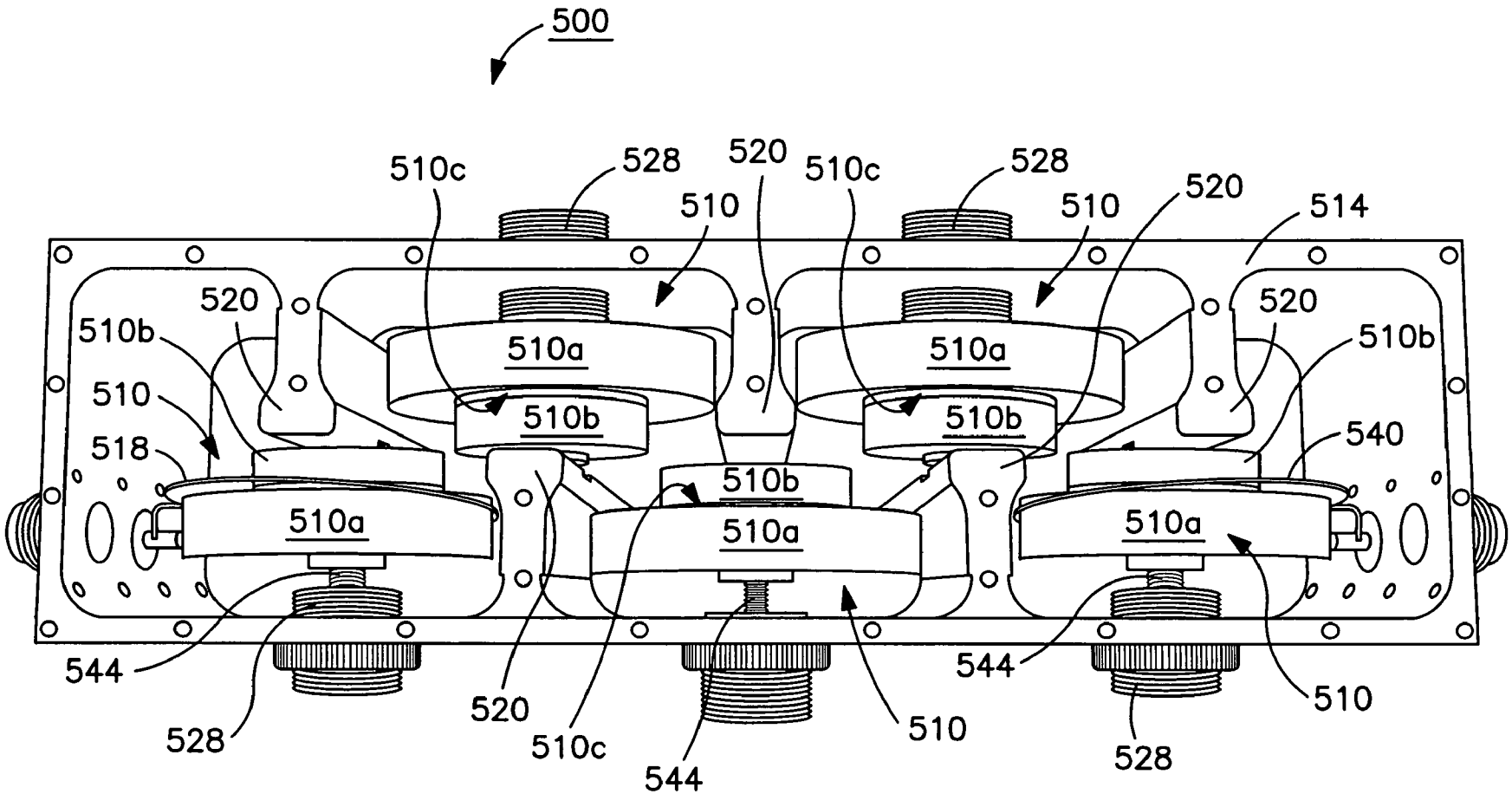
FIG. 5 is a side view of a dielectric resonator circuit in accordance with a second embodiment of the invention.

FIG. 5 is a perspective view of a five pole dielectric resonator filter 500 circuit employing the concepts of the present invention with the top removed in order to show the internal components. The resonators 510 are arranged in the cavity of an enclosure 514.

Each resonator comprises two cylindrical dielectric resonator body portions 510*a* and 510*b* separated by a plastic insert 510*c*.

Microwave energy is introduced into the cavity via a coupler 518 coupled to a cable, such as a coaxial cable (not shown). Conductive separating walls 520 separate the resonators from each other and block (partially or wholly) coupling between physically adjacent resonators 510 through the irises in walls 520.

The resonators are mounted on the enclosure via threaded screws 544. Metal tuning plates 528 having external threads are directly engaged in a matingly threaded hole in the wall of the enclosure to affect the field of the resonators and help set the center frequency of the filter. Particularly, plates 528 may be rotated to vary the spacing between the plates 528 and the resonator to adjust the center frequency of the resonator. Plates 528 having internally threaded central through bores through which mounting screws 544 for the resonators pass. Accordingly, the resonators can be moved longitudinally by rotating screws 544 inside of tuning plates 528 in order to move the resonators relative to each other so as to alter the coupling between adjacent resonators and thus the bandwidth of the filter.

Preferably, the dielectric resonators are mounted so as to overlap each other in the lateral direction, i.e., left-to-right in FIG. 5. This permits the dielectric resonators to be positioned very close to each other, in order to provide strong coupling between the resonators and increase bandwidth of the circuit.

The general concepts for tuning the filter of this embodiment are fully disclosed and discussed in U.S. Patent Application Publication Nos. 2005/0200437, 2004/0051602, and 2004/0257186, fully incorporated herein by reference.

An output coupler 540 is positioned adjacent the last resonator to couple the microwave energy out of the filter and into a coaxial connector (not shown). Signals also may be coupled into and out of a dielectric resonator circuit by other methods, such as microstrips positioned on the bottom surface of the enclosure adjacent the resonators, and loops printed on printed circuit boards.

While the invention has been illustrated in connection with to embodiments in which the overall resonator bodies comprised stepped cylinders, this is merely exemplary. The invention can be employed with conical resonators to provide even better tuning capability, spurious response, and other features in accordance with the teachings of aforementioned U.S. Patent Application Publication No. 2004/0051602. Furthermore, the invention can be applied with two cylindrical resonator body portions of equal diameter. In fact, the invention can be applied to dielectric resonators of essentially any shape.

U.S. Patent Application Publication No. 2006/0186972 entitled Dielectric Resonator With Variable Diameter Through Hole and Circuit with Such Dielectric Resonator discloses a dielectric resonator with a longitudinal through hole of variable cross section (e.g., diameter). The disclosure of that application is incorporated herein fully by reference. The cross section (i.e., the section taken perpendicular to the longitudinal direction) varies as a function of height (i.e., the longitudinal direction) and may vary abruptly (i.e., stepped), linearly (e.g., conical), or otherwise. The diameter of the through hole is selected at any given height so as to remove dielectric material at the height where the spurious modes primarily exist and to leave material at the height where the fundamental mode is concentrated.

The variable diameter through hole increases mode separation between the desired fundamental mode and the undesired higher order modes. Thus, the invention improves spurious response.

Figure 6:
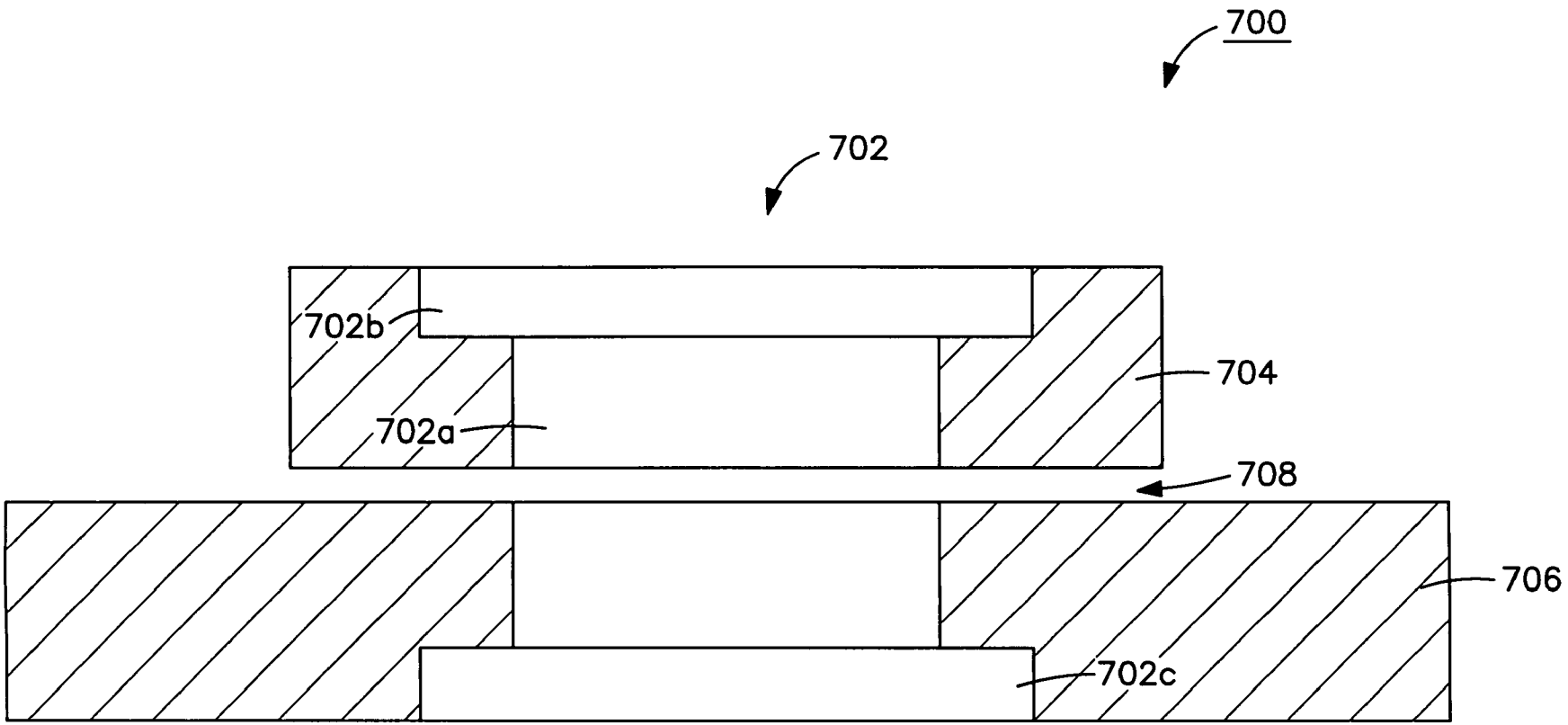
FIG. 6 is a side view of a dielectric resonator circuit in accordance with a second embodiment of the invention.
Figure 7:
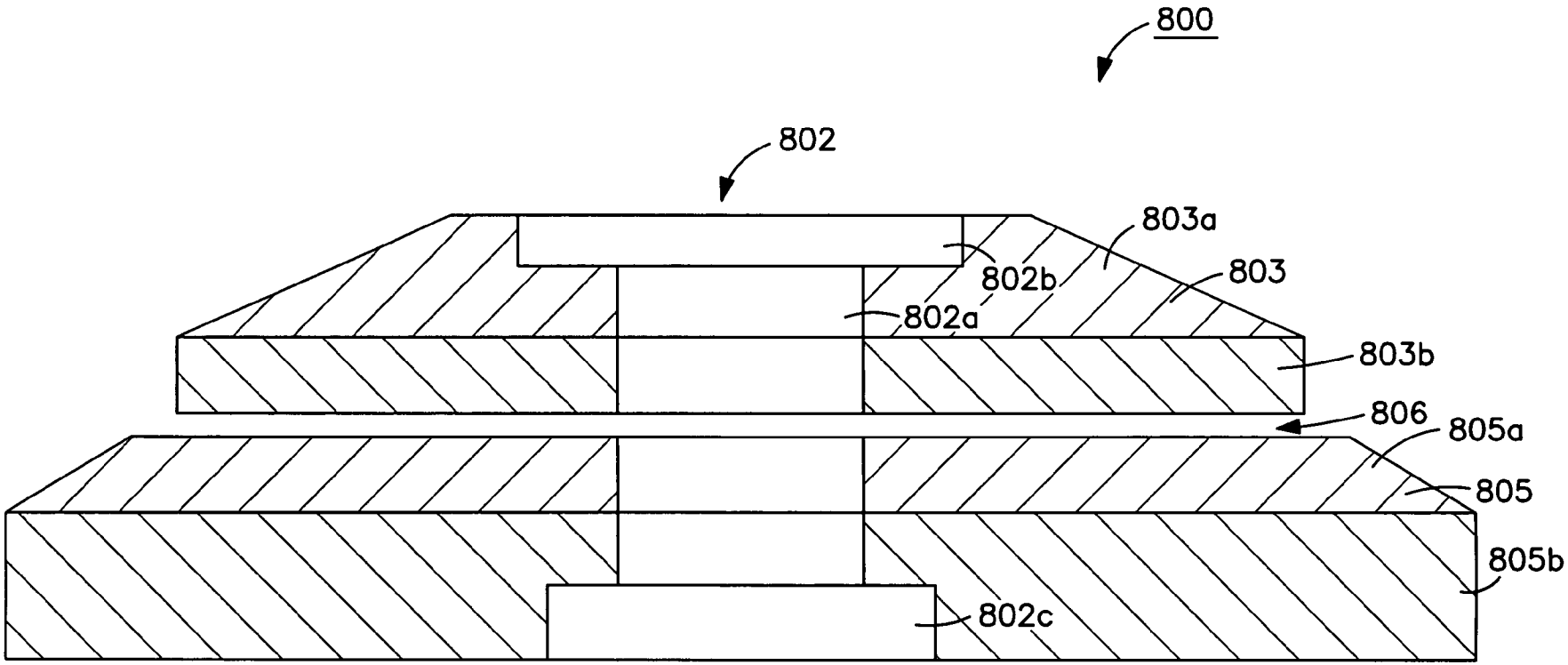
FIG. 7 is a side view of a dielectric resonator in accordance with another embodiment of the invention.

The present invention can be combined with the techniques, methods and apparatus disclosed in aforementioned U.S. Patent Application Publication No. 2006/018972, as illustrated in FIGS. 6 and 7. FIG. 6 illustrated the invention applied to a resonator 700 in which the through hole 702 has a variable diameter as a function of the longitudinal direction. In this particular embodiment, the overall resonator 700 comprises two separate cylindrical portions 704 and 706 of different diameter separated by an air gap 708. The through hole 702 comprises a central longitudinal portion 702*a* of a first diameter and two end portions 702*b*, 702*c*, of larger diameter. A filter built with dielectric resonators of this design would have the advantages of both the present invention and the invention disclosed in aforementioned U.S. Patent Application Publication No. 2006/0186972.

FIG. 7 illustrates another embodiment incorporating the features of the present invention into a dielectric resonator also having the features and advantages of aforementioned U.S. Patent Application Publication No. 2006/0186972. In this embodiment, the resonator body 800 includes two portions 803 and 805, each comprising a conical portion 803*a*, 805*a* with a chamfered bottom so as to form a cylindrical base 803*b*, 805*b*. An air gap 806 is provided between the two conical portions 803 and 805. The through hole 802 is similar to the one shown in the FIG. 6 embodiment, comprising a central longitudinal portion 802*a* of a first diameter and two end portions 802*b*, 802*c*, of larger diameter. A filter built with dielectric resonators of this design would have the advantages of both the present invention and the invention disclosed in aforementioned U.S. Patent Application Publication No. 2006/0186972.

The chamfer allows the dielectric resonators to be positioned closer to each other in order to provide even stronger coupling between the resonators, if needed.

Figure 8:
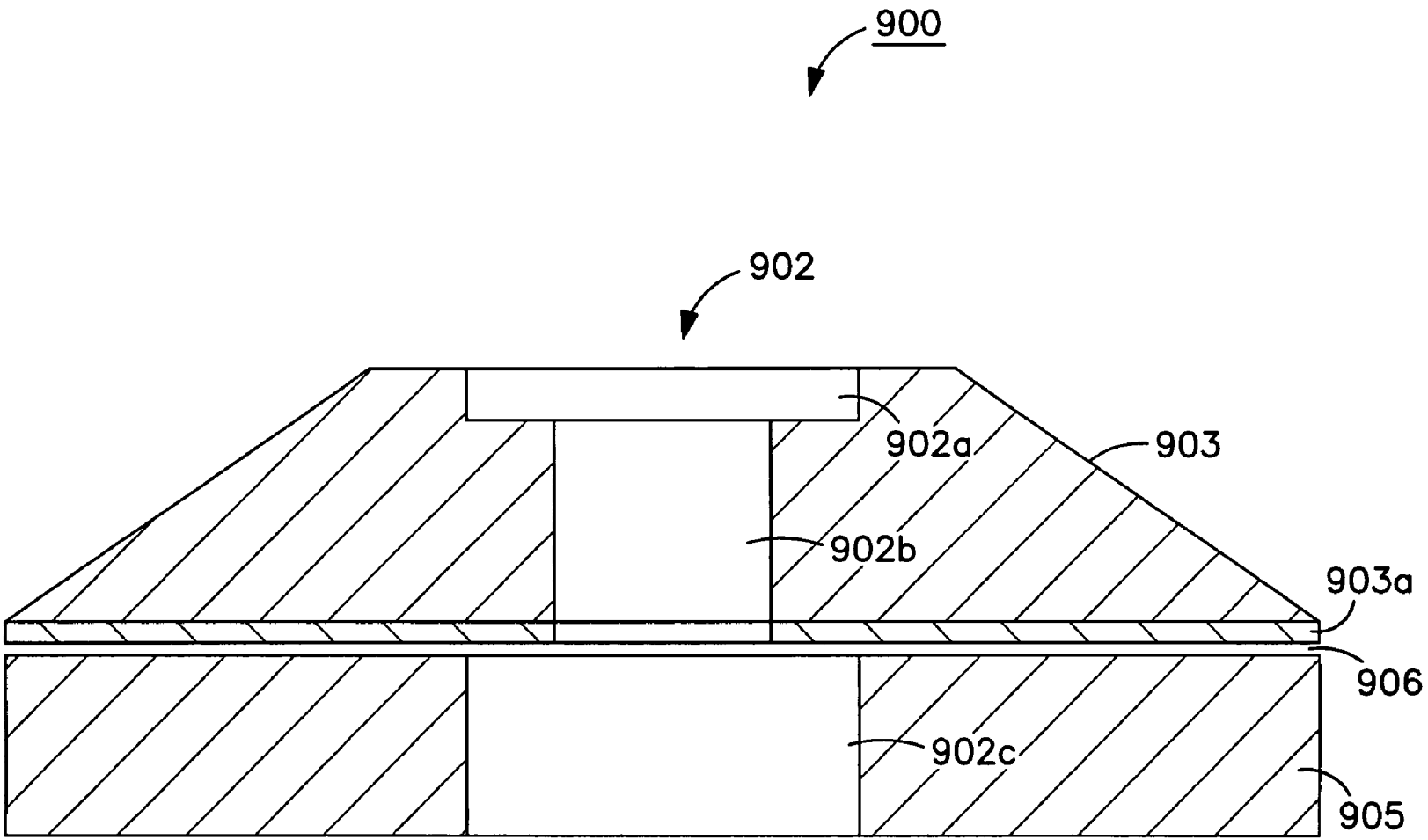
FIG. 8 is a side view of a dielectric resonator in accordance with yet another embodiment of the invention.

FIG. 8 illustrates a further embodiment of the invention incorporating the features of the present invention into a dielectric resonator 900. In this embodiment, the resonator body includes a lower portion 905 and an upper portion 903, the lower portion 905 is cylindrical and the upper portion 903 is conical. The upper body portion may or may not be provided with a small cylindrical base portion 903*a* (as in the FIG. 7 embodiment). A gap 906 is provided between portions 903 and 905. Gap 906, of course, may be an air gap or a plastic or other material having a lower dielectric constant than the dielectric material of body portions 903 and 905.

A longitudinal through hole 902 comprises a first, countersink portion 902*a* at the top of the resonator having a first diameter, a second portion 902*b* having a smaller diameter that runs most of the length of the upper body portion 903, and a third, bottom portion 902*c* having a diameter approximately equal to that of the first, upper portion 902*a*. The bottom portion of the through hole runs the entire axial length of the lower body portion 905 of the resonator body. The through hole can take on many other configurations, this one merely being exemplary. For instance, the through hole may have a countersink at the bottom as well as the top. A filter built with dielectric resonators of this design would have the advantages of both the present invention and the invention disclosed in aforementioned U.S. Patent Application Publication No. 2006/0186972.

Having thus described a few particular embodiments of the invention, various alterations, modifications, and improvements will readily occur to those skilled in the art. Such alterations, modifications, and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

We claim:

1. A dielectric resonator comprising a body comprised of dielectric material defining an axial dimension and a radial dimension orthogonal to said axial dimension, said body comprising a first axial body portion, a second axial body portion and a gap between said first and second axial body portions, said gap interrupting the continuity of said dielectric material in said first and second axial body portions along said axial dimension, and an axial through hole, wherein at least one of said first and second axial body portions is conical in shape, and wherein said at least one of said first and second axial body portions that is conical in shape includes a chamfered base.

2. The dielectric resonator of claim 1 wherein said gap comprises an air gap.

3. The dielectric resonator of claim 1 wherein said gap completely interrupts the continuity of said dielectric material in the axial dimension.

4. The dielectric resonator of claim 1 wherein said gap comprises a material having a dielectric constant of about 1.

5. The dielectric resonator of claim 1 wherein said first body portion is cylindrical in shape and said second body portion is conical in shape.

6. The dielectric resonator of claim 5 wherein said first, cylindrical body portion has a first diameter and said second, conical body portion has a first longitudinal end having a second diameter and a second longitudinal end having a third diameter smaller than said second diameter and wherein said second diameter is smaller than said first diameter.

7. The dielectric resonator of claim 1 wherein each said first and second body portions is conical in shape.

8. The dielectric resonator of claim 7 wherein said first and second conical resonator portions each includes a chamfered base.

9. A dielectric resonator circuit comprising at least first and second diejectric resonators, each resonator comprising a body comprised of dielectric material and defining an axial dimension and a lateral dimension orthogonal to said axial dimension, each said body comprising a first axial body portion, a second axial body portion and a gap between said first and second axial body portions, each said gap interrupting the continuity of dielectric material in said first and second axial body portions along said axial dimension and each said gap comprising a material having a dielectric constant smaller than a dielectric constant of said first body portion and a dielectric constant of said second body portion and said each body including a longitudinal through hole.

10. The dielectric resonator of claim 9 wherein at least one of said first and second axial body portions of each of said resonators is conical in shape.

11. The dielectric resonator circuit of claim 10 wherein each said conical axial body portions include a chamfered base.

12. The dielectric resonator of claim 9 wherein each said gap comprises an air gap.

13. The dielectric resonator of claim 9 wherein each said gap completely interrupts the continuity of said dielectric material of each of said at least first and second resonators in the axial dimension.

14. The dielectric resonator of claim 9 wherein each said gap comprises a material having a dielectric constant of about 1.

15. A dielectric resonator circuit comprising:

first and second dielectric resonators, each resonator comprising a body comprised of a respective dielectric material and defining an axial dimension and a radial dimension orthogonal to said axial dimension, each said body comprising a first axial body portion a second axial body portion and a gap between said first and second body portions, each said gap interrupting the continuity of the respective dielectric material in said first and second axial body portions along said axial dimension, each said body including a longitudinal through hole:

an enclosure containing said dielectric resonators:

an input coupler: and an output coupler;

wherein said first and second resonators are positioned so that at least a portion of said first resonator overlaps at least a portion of said second resonator in said radial dimension.

16. The dielectric resonator circuit of claim 15 wherein said gap of said first dielectric resonator comprises a material having a dielectric constant smaller than a dielectric constant of said dielectric material of said first axial body portion of said first dielectric resonator and a dielectric constant of said dielectric material of said second axial body portion of said first dielectric resonator and wherein said gar of said second dielectric resonator comprises a material havinci a dielectric constant smaller than a dielectric constant of said dielectric material of said second axial body portion of said second dielectric resonator and a dielectric constant of said dielectric material of said second axial body portion of said second dielectric resonator.

17. The dielectric resonator circuit of claim 15 wherein each said gap comprises a material having a dielectric constant of about 1.

18. The dielectric resonator circuit of claim 15 wherein said gap completely interrupts the continuity of said dielectric material of said first and second axial body portions of each of said first and second resonators in the axial dimension.

19. The diejectric resonator circuit of claim 15 further comprising:

a respective tuning plate corresponding to and mounted adjacent each dielectric resonator.

20. The dielectric resonator circuit of claim 15 wherein each said gap comprises an air gap.

21. A dielectric resonator comprising a body defining an axial dimension and a radial dimension orthogonal to said axial dimension, said body comprising a first axial body portion of a first dielectric material, a second axial body portion of a second dielectric material and a gap between said first and second axial body portions, said gap between said first and second axial body portions along said axial dimension and comprising a respective material having a dielectric constant smaller than a dielectric constant of said first dielectric material and a dielectric constant of said second dielectric material, and said dielectric body having an axial through hole, wherein at least one of said first and second axial body portions is conical in shape.

22. The dielectric resonator of claim 21 wherein said at least one of said first and second axial body portions that is conical in shape includes a chamfered base.

* * * * *